United States Patent [19]

Castleberry

[11] Patent Number: 4,873,516

[45] Date of Patent: Oct. 10, 1989

[54] METHOD AND SYSTEM FOR ELIMINATING CROSS-TALK IN THIN FILM TRANSISTOR MATRIX ADDRESSED LIQUID CRYSTAL DISPLAYS

[75] Inventor: Donald E. Castleberry, Schenectady, N.Y.

[73] Assignee: General Electric Company, Schenectady, N.Y.

[21] Appl. No.: 287,670

[22] Filed: Dec. 22, 1988

Related U.S. Application Data

[63] Continuation of Ser. No. 56,512, Jun. 1, 1987, abandoned.

[51] Int. Cl.[4] ..... G09G 3/36

[52] U.S. Cl. ..... 340/784; 340/805; 340/812

[58] Field of Search ..... 340/784, 805, 812, 765; 350/331 R, 332, 333

[56] References Cited

U.S. PATENT DOCUMENTS

| | | | |
|---|---|---|---|
| 4,485,380 | 11/1984 | Soneda et al. | 340/784 |
| 4,638,310 | 1/1987 | Hyliffe | 340/784 |
| 4,705,345 | 11/1987 | Ayliffe et al. | 340/784 |
| 4,714,921 | 12/1987 | Kanno et al. | 340/784 |

FOREIGN PATENT DOCUMENTS

| | | |
|---|---|---|
| 2146473 | 4/1985 | United Kingdom . |
| 2156567 | 10/1985 | United Kingdom . |
| 2173629 | 10/1986 | United Kingdom . |
| 2180385 | 3/1987 | United Kingdom . |

OTHER PUBLICATIONS

"Silicon TFTs for Flat Panel Displays", by F. Morin and M. LeContellec, Hewlett Packard Journal, (date unknown).

"Amorphous-Silicon Thin-Film Metal-Oxide-Semiconductor Transistors", by Hiroshi Hayama and Masakiyo Matsumura, *Applied Physics Letters,* vol. 36, No. 9 (May 1980).

"Amorphous Silicon-Silicon Nitride Thin-Film Transistors" by M. J. Powel et al., Applied Physics Letters, vol. 38, No. 10 (May 1981).

"Application of Amorphous Silicon Field Effect Transistors in Addressable Liquid Crystal Display Panels" by A. J. Snell et al., *Applied Physics,* vol. 24, pp. 357-362 (1981).

"A TFT-Addressed Liquid Crystal Color Display" by M. Sugata et al. (Oct. 1983), Proceedings of the Third International Display Research Conference, Paper No. 53.

"Amorphous-Silicon TFT Array for LCD Addressing" by M. V. C. Stroomer, Electronic Letters, vol. 18, No. 20 (1982).

"High Resolution Transparent-Type a-Si TFT LDCs" by K. Suzuki et al., SID Digest, (1983).

"Promise and Challenge of Thin-Film Silicon Approaches to Active Matrices" by A. I. Kakatos, 1982 International Display Research Conference, IEEE, pp. 146-151.

"Application of Amorphous Silicon Field Effect Transistors in Integrated Circuits" by A. J. Snell et al., Applied Physics, vol. A26, pp. 83-86.

(List continued on next page.)

*Primary Examiner*—David K. Moore
*Assistant Examiner*—Jeffery A. Brier
*Attorney, Agent, or Firm*—Marvin Snyder; James C. Davis, Jr.

[57] ABSTRACT

In a liquid crystal display, and more particularly, in a thin film transistor matrix addressed liquid crystal display, a method and means are provided for assuring the presence of a constant RMS voltage waveform on the data lines. This eliminates uncertainty in the voltage levels on a pixel element caused by parasitic capacitance effects between the data lines and the pixel electrodes. The present invention is also particularly applicable to both binary level and gray scale level devices. Means for carrying out the present method are illustrated in both analog and digital form.

9 Claims, 4 Drawing Sheets

OTHER PUBLICATIONS den Boer, W., "Determination of Midgap Density of States in a Si:H Using Space-Charge-Limited Current Measurements", *Journal of Physics,* Paris, vol. 42, C4, pp. 451-458.

Mackenzie, K. D. et al., "The Density of States in Amorphous Silicon Determined by Space-Charge-Limited Current Measurements", *Philosophical Magazine B,* vol. 46, No. 4, pp. 377-389, (1982).

Street, R. A. et al., "Effects of Doping on Transport and Deep Trapping in Hydrogenerated Amorphous Silicon", *Applied Physics Letters,* vol. 43, pp. 672-674 (Oct. 1983).

Sze, S. M., "Physics of Semiconductor Devices", 1st Edition, Wiley Interscience, p. 276, 1969.

Snell, A. J. et al., "Application of Amorphous Silicon Field Effect Transistors in Addressable Liquid Crystal Display Panels", *Applied Physics,* vol. 24, pp. 357-362 (1981).

Tuan, H. C. et al., "Dual-Gate a Si:H Thin Film Transistors", IEEE Electron Device Letters, vol. ED-L-3(12), pp. 357-359 (1982).

METHOD AND SYSTEM FOR ELIMINATING CROSS-TALK IN THIN FILM TRANSISTOR MATRIX ADDRESSED LIQUID CRYSTAL DISPLAYS

This application is a continuation of application Ser. No. 056,512, filed June 1, 1987 now abandoned.

BACKGROUND OF THE INVENTION

The present invention is generally directed to a method and means for eliminating cross-talk in liquid crystal display devices. The method is applicable to two-state display devices and also to gray level display devices. More particularly, the present invention is related to a display device in which means for preventing cross-talk between data lines and pixels is provided.

A proper understanding of the present invention can only be had by understanding the operation of a liquid crystal display device and the problems of parasitic capacitance inherent in the structure of these devices. In particular, a liquid crystal display device typically includes a pair of substrates fixed a specified distance apart. This distance is typically approximately 6 microns. A liquid crystal material is disposed between the substrates. The substrates are selected so that at least one of them is transparent. If back lighting is provided as a means for providing or enhancing the display and image, it is required that both substrates be substantially transparent. On one of these substrates there is disposed a transparent ground plane conductor typically comprising material such as indium tin oxide (ITO). The opposing substrate contains a rectangular array of individual electrode elements, called pixel electrodes. A semiconductor switch (preferably a thin film transistor) is associated with each of these pixel electrodes and is typically disposed on the substrate containing these electrodes. These transistor switches are usually based upon either amorphous silicon or polycrystalline silicon technology. At present, amorphous silicon technology is preferred because of its lower process temperature requirements. In effect, the aforementioned structure results in a rectangular array of capacitor-like circuit elements in which liquid crystal material acts as a dielectric. Application of voltage to a pixel electrode results in an electro-optical transformation of the liquid crystal material. This transformation is the basis for the display of text or graphical information seen on the device. It is noted that the invention herein is particularly applicable to the above-described display device in that each of the pixel electrodes is associated with its own semiconductor switch which may be turned on or off so that each individual pixel element may be controlled by signals supplied to its associated semiconductor switch. These semiconductor devices essentially act as electron valves for the deposition of charge on individual pixel electrodes.

Each transistor is provided with a scan line signal and a data line signal. In general, there are M data lines and N scan lines. Typically, the gate of each transistor switch is connected to a scan line and the source or drain of the transistor switch is connected to a data line.

In operation, a signal level is established on each of the M data lines. At this point, one of the N scan lines is activated so that the voltages appearing on the data lines is applied to the pixel electrodes through their respective semiconductor switch elements. A necessary consequence of the arrangement described is that each pixel electrode is surrounded on both sides by data lines. One of the data lines is the data line associated with the pixel electrode. However, the other data line is associated with an adjacent pixel electrode. This latter data line carries a different information signal. Also inherent in this structure are certain capacitive features. In particular, the pixel electrode and its opposing ground plane electrode portion form a capacitive structure. In addition, there are parasitic capacitances between each data line and its surrounding pixel electrode elements. Moreover, there is a parasitic capacitance which exists between the source and drain of the semiconductor switch element. The parasitic capacitances permit undesired signals to be applied to the pixel electrodes.

In a typical operational sequence, desired voltage levels are established on the data lines and a scan line is activated so as to apply these voltages to a single row of pixel electrodes. After a time sufficient for charging the LC capacitor, a different scan line is activated and a different set of data voltages is applied to a different pixel row. Typically, an adjacent pixel row is selected for writing video information. Thus, in a typical operation, one row of the display device can be written at one time, from the top to the bottom of the screen. In television applications, this top to bottom writing occurs in approximately 1/30th or 1/60th of a second. Thus, in this time period, a complete image is displayed on the screen. This image may include both text and graphical information.

As is well known in the electrical arts, capacitive effects are generally proportional to area and inversely proportional to distance. Thus, in high resolution liquid crystal display devices, the parasitic capacitance effects are particularly undesirable because of the requirement for small spacing between the lines. In typical applications contemplated herein, such as a television environment, the pixel electrodes are approximately 100 microns on a side and separated by a space of approximately 10 microns with an area of approximately $10\times10$ microns being set aside from each pixel for the placement of its associated semiconductor switch element. Thus it is found that in high resolution thin film transistor matrix addressed liquid crystal displays, the parasitic capacitance between the data lines and the pixel electrode is not insignificant when compared to the pixel capacitance. It is also noted that the parasitic capacitance between the data lines and the pixel electrode is increased by the presence of the parasitic source to drain capacitance in the switch element itself. In operation of such a display, the voltage on a pixel is set during its row address time. The semiconductor switch is then turned off and the voltage should remain fixed until the display is refreshed. However, any change in the voltage on an adjacent data line produces a change in the voltage on the pixel. In many drive schemes, the RMS voltage on a data line typically varies between 0 and 5 volts, depending on how many elements in the column are turned on. This results in an uncertainty or cross-talk in the voltage on the pixel. The maximum value for this voltage is $2 * [(C_D+C_{SD})/C_{LC}] * 5$ volts. Here $C_D$ is the parasitic capacitance arising from proximity of the data lines to the pixel electrode; $C_{SD}$ is the parasitic sourcedrain switch capacitance; and $C_{LC}$ is the capacitance associated with the liquid crystal cell structures itself. The factor of 2 results from the fact that there are two data lines adjacent to each pixel electrode. In a design in which there are approximately 100 pixels per inch, this results in a maximum voltage error of approximately 0.2 volts RMS. While this is not critical for on-off displays, it is very significant for gray scale displays where changes in the voltage of 0.05 volts RMS are visible.

One method for reducing cross-talk of the kind discussed above is the use of a storage capacitor in parallel with $C_{LC}$. This reduces the maximum error voltage. However, this method is undesirable because it usually requires additional processing steps, because it can cause additional defects to be present and because it reduces the active area of the pixel elements.

SUMMARY OF THE INVENTION

In accordance with a preferred embodiment of the present invention, a matrix addressed liquid crystal display device having means for sequentially applying an enabling signal on the scan lines also includes means for applying a plurality of data signals on the data lines. In the present invention, these data signals are operative in a period of time between successively activated scan line enabling signals so that during a first portion of this time, the desired voltage levels are impressed on the data lines. During a second portion of this time period, corrective voltage levels are applied to the data lines so that over the totality of these time periods, an approximately constant RMS voltage is applied to at least some of these data lines. In accordance with another embodiment of the present invention, a liquid crystal display is operated to achieve this constant RMS voltage. In accordance with another embodiment of the present invention, multiple scan line time periods are permitted to elapse before providing a corrective voltage level so as to again achieve an approximately constant RMS voltage over a specified period of time. Operating liquid crystal displays in this way eliminates the uncertainty in the voltage on a pixel element caused by the parasitic capacitance between data lines and the pixel electrode. Several means for achieving these results are provided herein.

Accordingly, it is an object of the present invention to eliminate cross-talk in thin film transistor matrix addressed liquid crystal displays caused by the presence of parasitic capacitive effects.

It is another object of the present invention to provide a method and means for operating a liquid crystal display device so as to achieve the presence of substantially constant RMS voltage data line waveform.

It is yet another object of the present invention to drive liquid crystal displays so that the voltage induced by the parasitic capacitance on a pixel electrode is the same for all pixel elements, particularly all pixel elements lying in a single column.

It is a still further object of the present invention to reduce the uncertainty in the pixel voltage level so that a constant shift exists which can be used to compensate by appropriate additive scaling of the data voltages.

It is a further object of the present invention to improve the operation of both gray scale and non-gray scale liquid crystal display devices.

Lastly, but not limited hereto, it is an object of the present invention to eliminate cross-talk in liquid crystal display devices.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
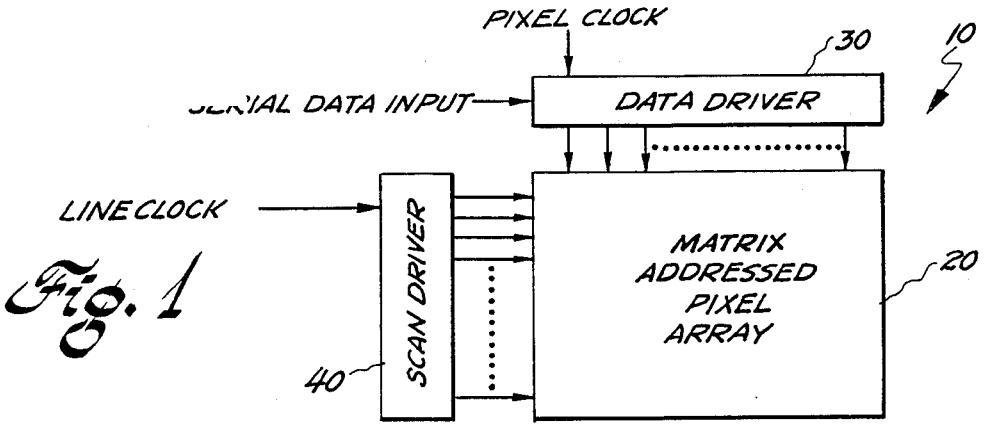
FIG. 1 is a schematic diagram illustrating an overall view of the structure of the present invention.

An overall view of a liquid crystal display device 10 is shown in FIG. 1. The primary component of such a device is array 20 of individually controllable pixel elements. Typically, this array is arranged in a rectangular grid with each grid location including a transparent pixel electrode and its associated semiconductor switch which functions to apply a voltage to its associated pixel electrode. There are typically as many semiconductor switches as pixel electrodes. However, it is noted that this is not required for the operation of the present invention. Also, while it is noted that the pixel array is generally established in a rectangular grid, the present invention is also not limited to the utilization of rectangular grid structures. For convenience of presentation and understanding, pixel array 20 may be considered to be a rectangular pixel array arranged in M columns and N rows. Data driver 30 is provided with serial data which represents video information in either analog or digital form. A pixel clock typically operating at M times the frequency of the indicated LINE CLOCK is used to effect proper timing for data driver 30. Data driver 30 thus typically possesses M output lines. These output lines are typically all valid at a particular point in time at which time scan driver 40, under control of the LINE CLOCK signal permits data from the M output data driver lines to be applied to a row of pixel electrodes through the operation of a semiconductor switch disposed, for example, at the intersection of the $m^{th}$ data driver line and the $n^{th}$ scan driver line. Accordingly, it is seen that there is a scan driver line for each row of pixel array 20. Thus there are, in general, N output lines from scan driver 40.

Figure 2:
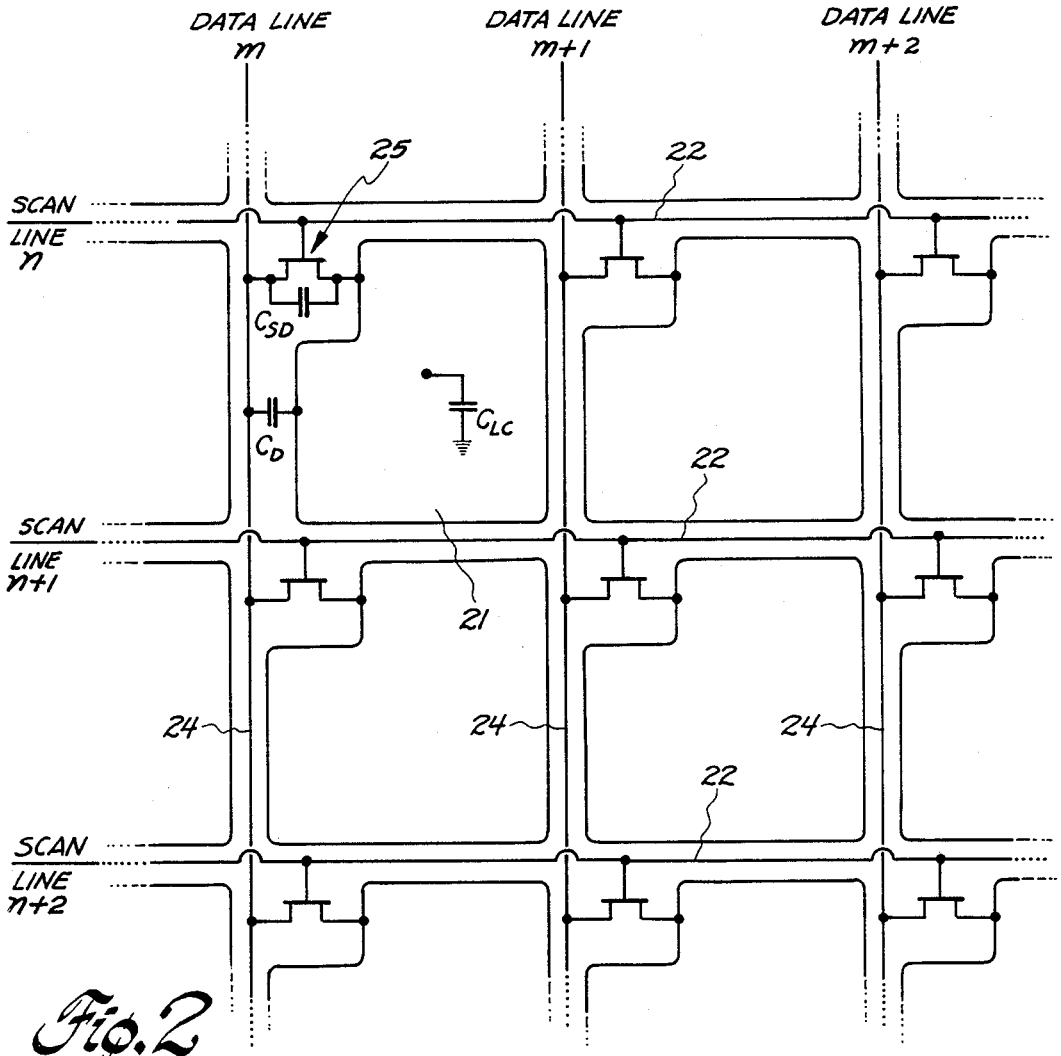
FIG. 2 is an electrical circuit schematic diagram of a portion of the pixel array shown in FIG. 1 which particularly illustrates the presence of the parasitic capacitances whose effects are sought to be mitigated by the present invention.

The particular problem presented by the pixel electrode and data electrode arrangement is more particularly illustrated in FIG. 2. In particular, attention is directed to the pixel electrode associated with $m^{th}$ data line and the $n^{th}$ scan line. It is noted therein that a capacitive circuit element $C_{LC}$ exists as a result of the presence of pixel electrode 21 in conjunction with its opposing ground plane electrode portion (not visible) and the associated liquid crystal material (also not visible). Also shown in FIG. 2 is the presence of parasitic $C_{SD}$ source drain capacitance associated with switching element 25. This capacitance is denoted symbolically by. $C_{SD}$. Also shown in FIG. 2 is the presence of parasitic capacitance $C_D$ which exists between the $m^{th}$ data line and the indicated pixel electrode 21. (Other pixel electrodes are shown, but are not provided with reference numerals.) It is further noted that a parasitic capacitance exists between pixel electrode 21 and data line (m+1) to its right in FIG. 2. However, it is assumed herein th-at this capacitance is considered in a determination of the value for $C_D$ with which it is associated. It is also noted that capacitance $C_D$ and capacitance $C_{SD}$ are effectively in parallel and thus their effects are additive. It is further seen that data lines are referred to by reference numeral 24; likewise, scan lines are referred to by reference numeral 22.

The problem solved by the present invention is now considered further with a more thorough analysis of FIG. 2. In particular, with respect to pixel electrode 21, it is observed that voltage signals occurring on data line (m+1) may be applied to pixel electrode 21 through its capacitive coupling (not shown, see above) to this data line which exists as a result of the necessarily close proximity between pixel electrode 21 and data line (m+1). In a similar fashion, signals applied to data line m may also appear on pixel electrode 21 even though semiconductor switch 25 is turned off as a result of voltages applied to data line m because parasitic capacitance $C_{SD}$ can operate to couple data line m with pixel electrode 21. Likewise, pixel electrode 21 is also capacitively coupled through $C_D$ to data line m for the same reasons that is coupled to data line (m+1). Thus, during time intervals in which information is being supplied to other rows (e.g., scan line (n+1) or scan line (n+2) active), spurious signals may also be applied to row n. It is this problem which the present invention seeks to ameliorate. For purposes of illustration, the parasitic capacitances are shown for the cell in row n and column m only; while these effects exist for all of the pixel cells, they are only considered for the aforementioned cell for purposes of illustration herein.

Figure 3:
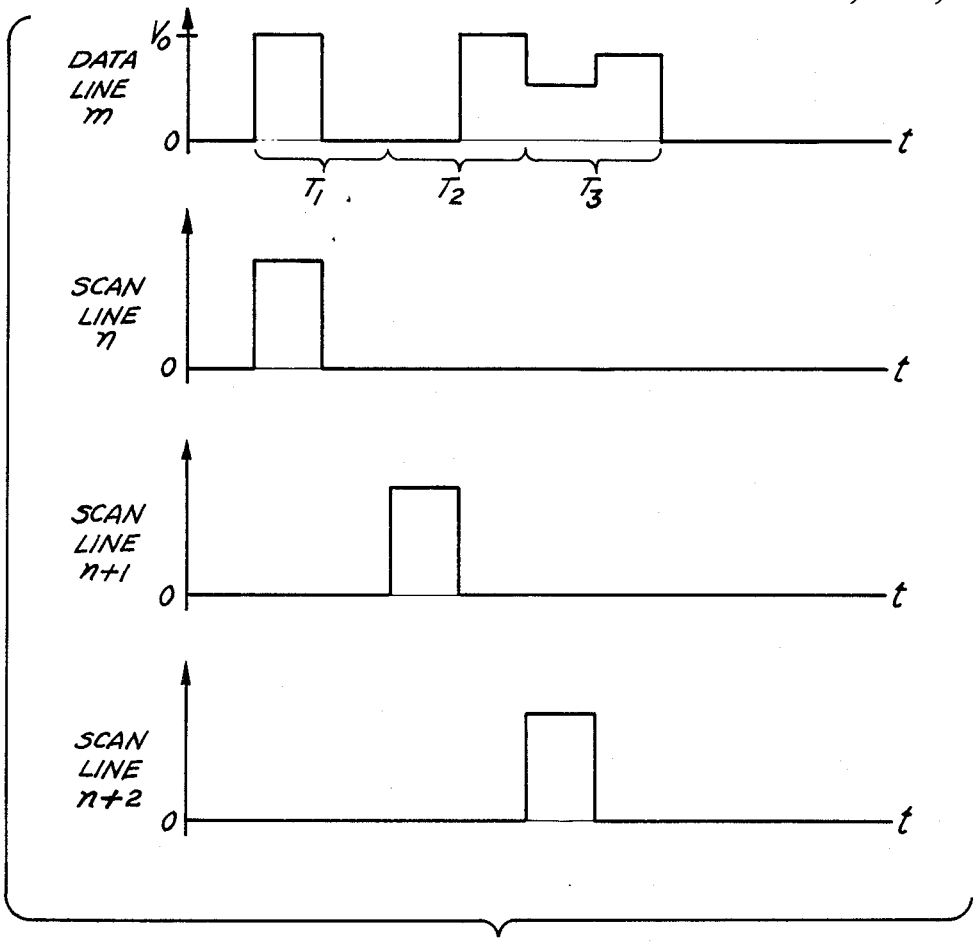
FIG. 3 is a graph of voltage versus time for specified data line and scan line signals.

The method for solving the aforementioned cross-talk problems is illustrated in FIG. 3. In particular, the first waveform illustrated therein illustrates two methods for solving the problem. Time periods $T_1$ and $T_2$ are associated with one of these methods. Time period $T_3$ is associated with another of these methods. They are shown on the same time scale only for convenience of presentation.

First is considered the operation of the present invention in time periods $T_1$ and $T_2$. The method for cross-talk correction illustrated for the time period $T_1+T_2$ is applicable to binary (that is, on-off) displays. In particular, the waveform shown in the first two graphs of FIG. 3 illustrates the signals which are deliberately applied to the pixel electrode in the $n^{th}$ row and $m^{th}$ column. When scan line n is active (as during the first half of period $T_1$), a "1" is written onto the pixel electrode. During the second half of period $T_1$, a "0" is applied to the data line, although it is not written into the pixel electrode since the scan pulse is not active for the second half of it. The opposite situation is true if it is desired in period $T_1$ to write a binary "0" into the same pixel cell. Thus, over the period of time $T_1$ there is a constant RMS voltage applied to data line m. A compensating voltage may be applied to counteract this constant RMS voltage so as to provide a better screen image.

Attention is now directed to the method of cross-talk elimination illustrated in period $T_3$. It is again noted that these two separate methods are shown in the same figure only for convenience and for purposes of comparison. In general, the voltage waveforms shown for data line m in period $T_3$ are of a different character than the simple binary complements illustrated for those applied in the time period $T_1+T_2$. In particular, the method illustrated by the waveform on data line m in period $T_3$ is applicable to the situation in which gray scale displays are employed. For gray scale displays, a voltage $V_1$ such that $O \leqq V_1 \leqq V_{max}$ is applied during the first half of the line address time and its RMS complement is applied for the second half. In particular, its RMS complement is computed as:

$$V_2 = \sqrt{V_{max}^2 - V_1^2}.$$

Thus in time $T_3$ period there are two distinct voltages applied to data line m. In the first half of the time period, the voltage applied is $V_1$. In the second half of the time period $T_3$, the voltage applied to data line m is $V_2$, its RMS complement. Again, this assures a constant RMS voltage on data line m. It is further noted that if higher voltages than $V_0=V_{max}$ are available, then correction may be applied over a shorter time duration to produce the same constant RMS voltage levels. It is not necessary that the time interval $T_3$ be split in two equal parts.

Figure 4:
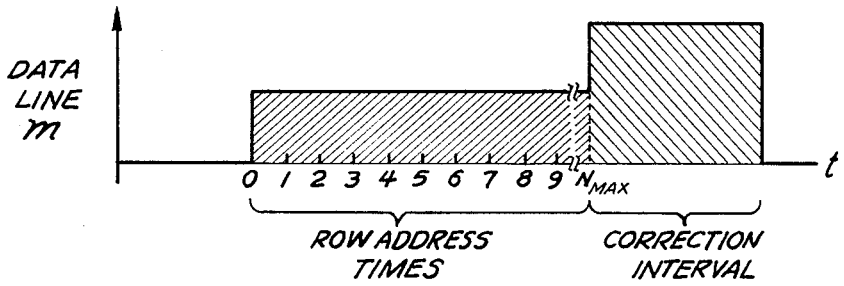
FIG. 4 is a graph of voltage as a function of time for a data line in which the RMS correction voltage is applied subsequent to a specified plurality of scan line activation periods.

Another embodiment of the present invention is illustrated in FIG. 4. The principles involved, however, are nonetheless the same. In particular, after a certain number of row address times, $N_{max}$, a correction voltage is applied to data line m so that over an extended period of time, the RMS voltage is a constant value. As illustrated in FIG. 4, the voltage applied in the correction interval is selected to be the RMS complement of the average voltage applied during the $N_{max}$ row address times. It is noted that FIG. 4 illustrates relative values and timing and that in particular, during the row address times illustrated, it is not necessarily true that the data values are all binary ones. In the implementation illustrated in FIG. 4, all data lines are addressed in a normal manner and then an RMS correction waveform is applied to give constant RMS voltage on the data line over the whole internal (row address times+correction interval). If the same amplitude is applied during the correction, the correction time interval is equal to $N_{max}$ row address times. If twice the maximum data voltage is available, only one-fourth of the row address time is required.

Figure 5:
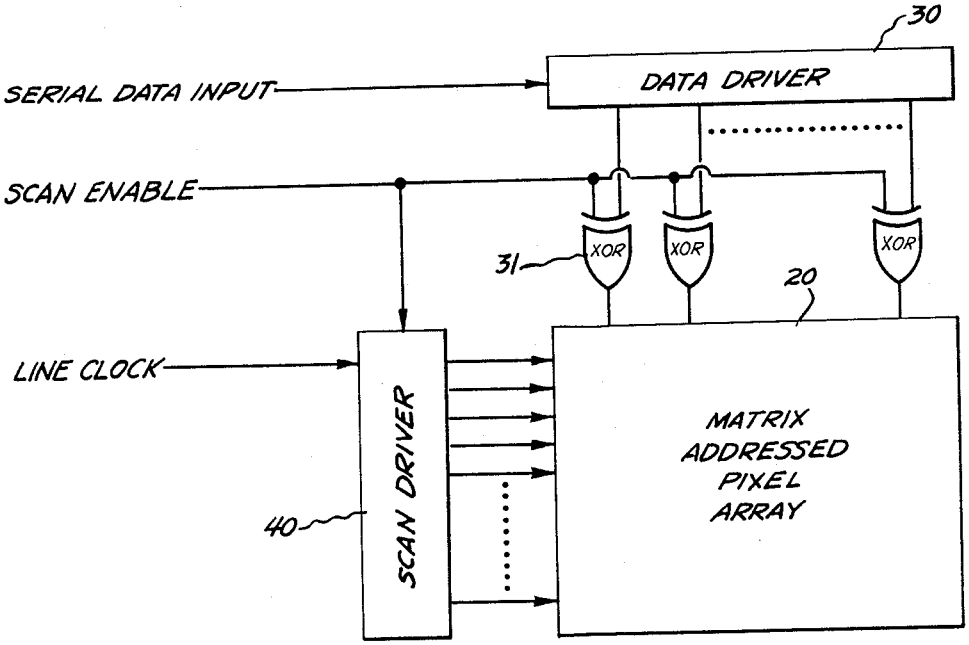
FIG. 5 is a schematic diagram illustrating one method for application of RMS voltage correction waveforms for the situation in which an on-off display is employed.
Figure 6:
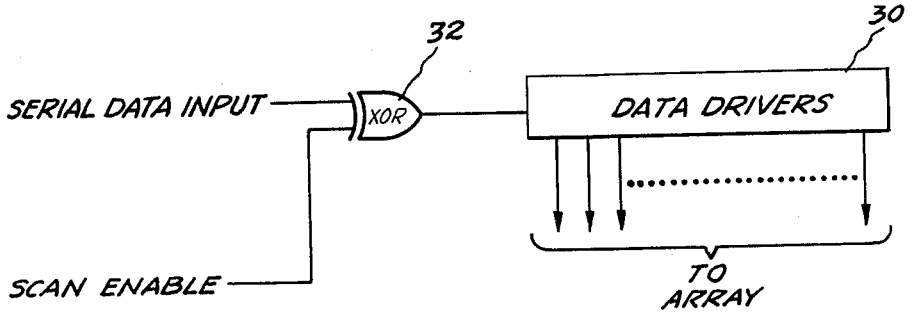
FIG. 6 is a schematic diagram illustrating a variation of the circuit shown in FIG. 5.

An illustration of digital means to accomplish the method illustrated in periods $T_1$ and $T_2$ of FIG. 3 is illustrated in FIGS. 5 and 6. In particular, it is noted that EXCLUSIVE OR circuits 31 may be employed to perform the desired binary complementation operation indicated above. For a bilevel display, this circuit provides a constant RMS waveform which is generated by inverting the data for half of the line address time enabling the scan output for the non-inverted half of the line address time. This is accomplished with an EXCLUSIVE OR gate on each data driver output as illustrated in FIG. 5 or by the use of an EXCLUSIVE OR gate on the serial data input line to a shift register in data driver 30. In this latter implementation, data is fed into the data drivers twice for each line address time. It is also noted that in this latter embodiment, only a single EXCLUSIVE OR circuit 32 need be employed (see FIG. 6).

Figure 7:
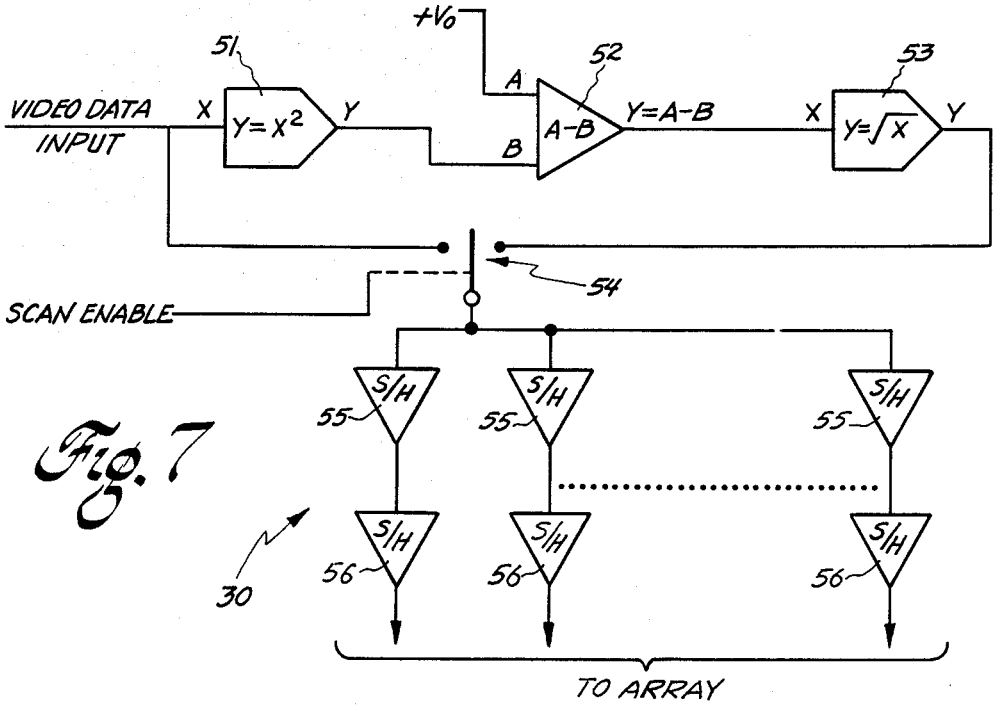
FIG. 7 is a schematic diagram of an analog RMS voltage compensation scheme for gray scale display devices.

For a multilevel or gray scale display, implementations of the corrective method described above are shown in FIGS. 7 and 8. In particular, in the circuit shown in FIG. 7, analog sample and hold drivers 55 and 56 are employed. The RMS complement is generated using analog circuits such as squarer 51, adder/subtracter 52, square root calculator 53 and switch 54 which is selected by the scan enable signal to select raw input line video data or analog video data which has been processed to produce RMS complement values. Timing signals applied to sample and hold circuits 55 and 56 insure that valid data is simultaneously available to a single selected row of the display as determined by its associated video display data.

Figure 8:
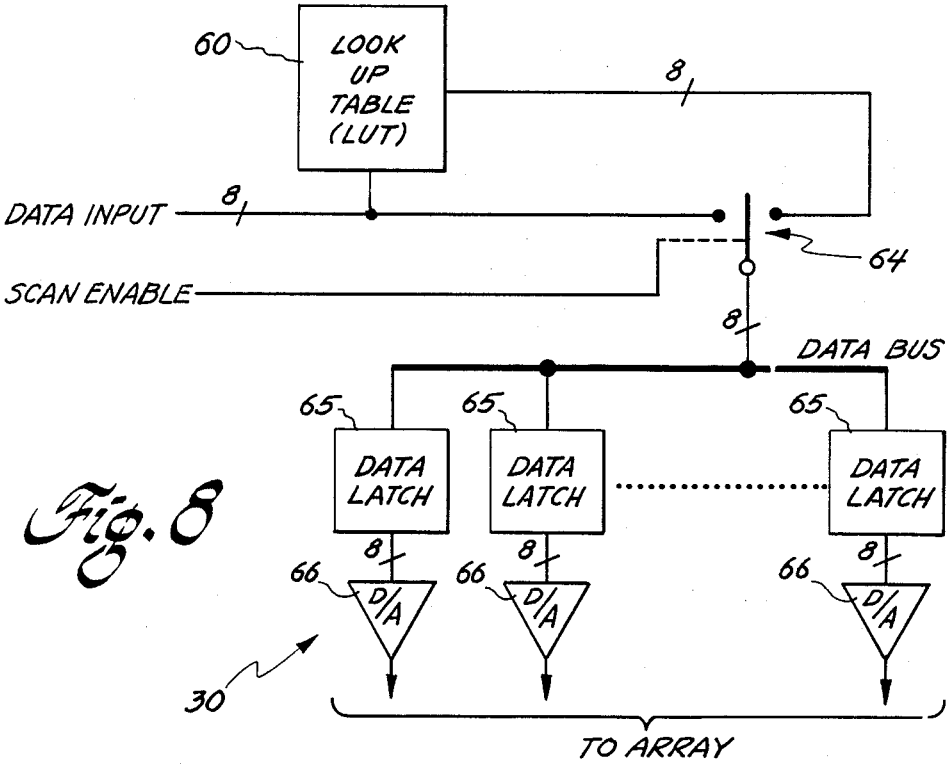
FIG. 8 is a schematic diagram illustrating an alternate digital gray scale display compensation system.

A second implementation of RMS complement generation means is illustrated in FIG. 8. This implementation uses digital data and a lookup table (LUT) to determine the RMS complement. Digital to analog converters 66 are used as the data line drivers. In particular, FIG. 8 illustrates the situation in which video data is input in digital form with 8 bits being assigned to determine one of 256 gray scale levels applicable to the pixel electrodes. In particular, data is supplied to lookup table 60 which represents (for example) a 256×256 element ROM which is employed to determine RMS complements for any of the possible 256 data input combinations. The scan enable signal is operative to control switch 64 which selects either the raw digital data or digital data which has been processed to determine its RMS complement. For example, see the waveform illustrated in the second half of time period $T_3$ in the first graph shown in FIG. 3 above. This 8 bit binary data is supplied to the data bus and to data latches 65. Each of these latches drives a digital-to-analog converter 66 which is used to drive the various data lines in the pixel array. In this manner, the desired RMS voltage waveform is applied to the data lines to achieve the desired constant RMS voltage.

Accordingly, it is seen that the method and apparatus of the present invention are suitable for the elimination of cross-talk in matrix addressed liquid crystal displays. More particularly, it is seen that the method and apparatus of the present invention provide a means for compensating for additional signals which may be undesirably applied to the various pixel elements. It is seen that this method is particularly important in high resolution displays because of the higher parasitic effects resulting from closer proximity structures. Thus, the uncertainty in the voltage on an element caused by the parasitic capacitance between the data lines and the pixel electrodes is removed. It is noted that the method of the present invention is readily implementable and solves a significant problem in the fabrication of high resolution liquid crystal display devices.

While the invention has been described in detail herein in accord with certain preferred embodiments thereof, many modifications and changes therein may be effected by those skilled in the art. Accordingly, it is intended by the appended claims to cover all such modification and changes as fall within the true spirit and scope of the invention.

The invention claimed is:

1. A display device comprising:

a plurality of pixel electrodes disposed in a grid pattern on a first insulative substrate;

a plurality of semiconductor switching devices connected to, so as to be associated with, corresponding pixel electrodes;

a second substrate having disposed thereon at least one ground plane electrode, said second substrate being disposed adjacent to said first substrate at a predetermined distance therefrom;

liquid crystal material disposed between said substrates so that said pixel electrodes, said at least one ground plane electrode and said liquid crystal material form electrical devices having capacitive characteristics;

a plurality of electrically conductive scan lines, each said scan line being connected to a plurality of said semiconductor switching devices associated with a row of said pixel electrode grid;

a plurality of electrically conductive data lines, each said data line being connected to a plurality of said semiconductor switch devices associated with a column of said pixel electrode grid;

means for sequentially applying an enabling unipolar signal to said scan lines; and means for applying a plurality of unipolar data signals to said data lines, said data signals being operative, in a period of time between initiation of successively activated scan line enabling signals, so that during a first portion of said tine period desired voltage levels are impressed on said data lines and during a second portion of said time period, corrective voltage levels are applied to said data lines so that in said time period, an approximately constant RMS voltage is applied to at least some of said data lines.

2. The device of claim 1 in which said corrective voltage levels are the binary complements of said desired voltage levels.

3. The device of claim 1 in which said corrective voltage levels represent the RMS complement of said desired voltage levels.

4. The device of claim 1 in which said first portion of said time period and said second portion of said time period are equal in duration.

5. A method for driving a thin film transistor matrix addresses liquid crystal display having scan lines extending in a first direction and data lines extending in a second direction, said method comprising:

sequentially applying an enabling unipolar signal to said scan lines; and applying a plurality of unipolar data signals to said data lines, said data signals being operative, in a period of time between initiation of successively activated scan line enabling signals, so that during a first portion of said time period desired voltage levels are impressed upon said data lines and during a second portion of said period, corrective voltage levels are applied to said data lines so that, in said time period, an approximately constant RMS voltage is applied to at least some of said data lines.

6. The method of claim 5 in which said corrective voltage levels are the binary complements of said desired voltage levels.

7. The method of claim 5 in which said corrective voltage levels represent the RMS complement of said desired voltage levels.

8. The method of claim 5 in which said first portion of said time period and said second portion of said time period are equal in duration.

9. A display device comprising:

a plurality of pixel electrode disposed in a grid pattern on a first insulative substrate;

a plurality of semiconductor switching device connected to, so as to be associated with, corresponding pixel electrodes;

a second substrate having disposed thereon at least one ground plane electrode, said second substrates being disposed adjacent to said first substrate at a predetermined distance therefrom;

liquid crystal material disposed between said substrates so that said pixel electrodes, said at least one ground plane electrode and said liquid crystal material form electrical devices having capacitive characteristics;

a plurality of electrically conductive scan lines, each said scan line being connected to a plurality of said semiconductor switching devices associated with a row of said pixel electrode grid;

a plurality of electrically conductive data lines, each said data line being connected to a plurality of said semiconductor switch device associated with a column of said pixel electrode grid;

means for sequentially applying an enabling unipolar signal to said scan lines; and means for applying a plurality of unipolar data signals to said data lines, said means being operative, in a period of time equal to a multiple of the time period between successive applications of said scan line signals, so that during said extended period various desired voltage levels are impressed on said data lines and that during a period subsequent to this extended period, a corrective voltage level is applied to said data lines so that over said extended period and said subsequent period an approximately constant RMS voltage is applied to at least some of said data lines.

* * * * *